US011230027B2

(12) United States Patent
Do

(10) Patent No.: US 11,230,027 B2
(45) Date of Patent: Jan. 25, 2022

(54) RECHARGEABLE HYDRAULIC PUNCHING MACHINE FOR CABLE TRAY

(71) Applicant: Youngsuk Roh, Daegu (KR)

(72) Inventor: Gyutae Do, Daegu (KR)

(73) Assignee: Youngsuk Roh, Daegu (KR)

( * ) Notice: Subject to any disclaimer, the term of this patent is extended or adjusted under 35 U.S.C. 154(b) by 0 days.

(21) Appl. No.: 16/975,175

(22) PCT Filed: Jun. 21, 2019

(86) PCT No.: PCT/KR2019/007500
§ 371 (c)(1),
(2) Date: Aug. 24, 2020

(87) PCT Pub. No.: WO2020/013476
PCT Pub. Date: Jan. 16, 2020

(65) Prior Publication Data

US 2021/0086389 A1 Mar. 25, 2021

(30) Foreign Application Priority Data

Jul. 10, 2018 (KR) ..... 10-2018-0079767

(51) Int. Cl.
*B26F 1/34* (2006.01)

(52) U.S. Cl.
CPC ..... *B26F 1/34* (2013.01)

(58) Field of Classification Search
CPC ..... B26F 1/34; B26F 1/381
USPC ..... 30/362, 358
See application file for complete search history.

(56) References Cited

U.S. PATENT DOCUMENTS 3,893,239 A * 7/1975 Giebel ..... E01B 31/06 30/358
5,233,749 A * 8/1993 Saito ..... B21D 28/002 30/228
5,598,635 A * 2/1997 Saito ..... B21D 28/243 30/362
7,412,868 B2 * 8/2008 Frenken ..... B25B 27/10 60/477

(Continued)

FOREIGN PATENT DOCUMENTS

JP H05-245799 A 9/1993
JP H07-251308 A 10/1995
KR 10-1387746 B1 4/2014

(Continued)

*Primary Examiner* — Omar Flores Sanchez
(74) *Attorney, Agent, or Firm* — KORUS Patent, LLC; Seong Il Jeong

(57) ABSTRACT

The present invention relates to a rechargeable hydraulic punching machine for a cable tray, in which a battery, a grip, a motor, a hydraulic cylinder, a punch, and a die are sequentially disposed along a straight line, a C-shaped head coupled to the head of the hydraulic cylinder is disposed, the punch and the die are disposed at both open ends of the C-shaped head, respectively, punch guards are disposed on a portion of the head spaced apart from both sides of the punch, the battery is configured to be charged and detachably attached, the motor transfers power to the hydraulic cylinder by using the power of the battery, and the hydraulic cylinder punches assembly holes of a cable tray by pushing the punch in the direction of the die by using hydraulic power based on the power of the motor.

6 Claims, 12 Drawing Sheets

(56) References Cited

U.S. PATENT DOCUMENTS 9,808,853 B2 * 11/2017 Frenken ..... B26F 1/12

FOREIGN PATENT DOCUMENTS

KR 20-2014-0006077 U 12/2014
KR 10-1532619 B1 7/2015

* cited by examiner

RECHARGEABLE HYDRAULIC PUNCHING MACHINE FOR CABLE TRAY

TECHNICAL FIELD

The present invention relates generally to a rechargeable hydraulic punching machine for a cable tray, and more particularly to a rechargeable hydraulic punching machine for a cable tray, in which a battery, a grip, a motor, a hydraulic cylinder, a punch, and a die are sequentially disposed along a straight line, a C-shaped head coupled to the head of the hydraulic cylinder is disposed, the punch and the die are disposed at both open ends of the C-shaped head, respectively, punch guards are disposed on a portion of the head spaced apart from both sides of the punch, the battery is configured to be charged and detachably attached, the motor transfers power to the hydraulic cylinder by using the power of the battery, and the hydraulic cylinder punches assembly holes of a cable tray by pushing the punch in the direction of the die by using hydraulic power based on the power of the motor, thereby enabling the battery to be recharged and replaced and also facilitating the carrying and use of the rechargeable hydraulic punching machine.

BACKGROUND ART

In general, cable trays are used to organize multiple strands of cables that are deployed along a ceiling, a floor, or a wall. A cable tray is formed in a ladder structure and installed in a straight line or a curved line according to the place where cables are deployed. A cable tray supports and fastens several strands of cables in an orderly state in the space between a wall and the cable tray.

Furthermore, as shown in FIG. 1, a typical cable tray includes two side rails 21 disposed side by side in a longitudinal direction in a state in which U-shaped sections face each other and rungs 23 connected at regular intervals between the two opposite side rails 21. Joint connectors 24 are provided for the length extension of the cable tray 2 or connection with the curved cable tray 2. These joint connectors 24 are formed to have sideways U-shaped sections that cover the outsides of the two side rails 21 that are in contact with each other. The corresponding assembly holes are drilled in the two side rails 21 and the joint connectors 24, and bolts 26 are tightened through the corresponding assembly holes 22 of the two side rails 21 and the joint connectors 24.

In this case, when the two cable trays 2 are connected with the joint connectors 24, bonding jumpers 25 are additionally provided, corresponding assembly holes 22 are formed in the ends of the bonding jumpers 25 and the side rails 21 of the two cable trays 2, and the bolts 26 are tightened therethrough.

In this case, the assembly holes 22 drilled in the side rails 21 are formed according to planned lengths and planned connection locations in advance. However, there occur cases where the assembly holes 22 are required to be drilled in the side rails 21 at a site due to an error from a site, or a change in plan. In this case, conventionally, locations to be drilled are measured with a ruler, the measured locations are marked, and the assembly holes 22 are drilled at the marked locations.

Technology for performing faster, more convenient and accurate operation in the drilling of the assembly holes 22 of the conventional cable tray 2 is being developed. In Korean Patent Application Publication No. 2013-0084847 entitled a "cable tray punching tool using an anchor drill," there is disclosed a cable tray punching tool. The cable tray punching tool includes: a fastening member configured to have a fitting groove for receiving a cable tray to form assembly holes in another cable tray having no assembly hole and have a machining hole formed in the same location as an assembly hole formed in the cable tray; a moving member configured to have a fitting groove and a machining hole having the same depths as the fastening member; an adjusting member installed to be adjustable according to the vertical interval and width of the cable tray by moving the moving member back and forth from the fastening member; fastening bolts installed in the tops of the fastening member and the moving member to prevent movement in a state in which the cable tray is inserted into the fitting grooves of the fastening member and the moving member; and an anchor drill configured to drill a plurality of assembly holes in the cable tray, fastened by the fastening bolts, through the machining holes formed in the fastening member and the moving member.

DISCLOSURE

Technical Problem

However, a "cable tray punching tool using an anchor drill" disclosed in Korean Patent Application Publication No. 2013-0084847 includes the fastening member, the moving member, the adjusting member and the fastening bolt. Assembly holes to be drilled are marked and guided, but the assembly holes of the cable tray are drilled by using the tool including an anchor drill. Accordingly, problems arise in that the sharp scraps formed by the anchor drill are dispersed, so that there is a risk that a product or the skin of a user may be damaged by the dispersed sharp scraps and in that the anchor drill is supplied with electricity via the electric cable, so that a limitation to movement is imposed due to the length of the electric cable, it is inconvenient to connect the electric cable during use, and encumbering is caused by the electric cable.

Furthermore, the conventional method of drilling assembly holes of a cable tray using an electric drill has the same problem.

Therefore, there is a need to develop a device that can be easily used and carried and can easily drill assembly holes of a cable tray.

Technical Solution

Accordingly, the present invention provides a rechargeable hydraulic punching machine for a cable tray, in which a battery, a grip, a motor, a hydraulic cylinder, a punch, and a die are sequentially disposed along a straight line, a C-shaped head coupled to the head of the hydraulic cylinder is disposed, the punch and the die are disposed at both open ends of the C-shaped head, respectively, punch guards are disposed on a portion of the head spaced apart from both sides of the punch, the battery is configured to be charged and detachably attached, the motor transfers power to the hydraulic cylinder by using the power of the battery, and the hydraulic cylinder punches assembly holes of a cable tray by pushing the punch in the direction of the die by using hydraulic power based on the power of the motor, thereby enabling the battery to be recharged and replaced and also facilitating the carrying and use of the rechargeable hydraulic punching machine.

In this case, the head is formed such that the straight-line length from an inner end of an open opposite side to the punch is 80 to 130 mm, a movement limiting element is provided to be moved from the inner end of the open opposite side of the head, and the location of the movement limiting element is adjusted by the length from an end of the cable tray to a punching location, the cable tray is inserted into the head, and then punching is performed, thereby facilitating the adjustment of a location of the cable tray to be punched.

Furthermore, a marking pen part, a guide part and a jig part configured to be coupled to the punch guards are provided and coupled for use, so that during punching, a location to be punched next is marked using the coupled marking pen part, guiding to a location to be punched is performed using the coupled guide part, and a location to be punched can be fastened using the coupled jig part, thereby facilitating use.

Advantageous Effects

As described above, the present invention has effects in that it is possible to charge and replace the battery, it is easy to carry and use the rechargeable hydraulic punching machine, and hydraulic punching is performed, thereby reducing surrounding contamination attributable to the formation of the assembly holes compared to drilling.

In addition, the present invention also has effects in that it is easy to determine a location to be punched next by using the coupled marking pen unit, guiding is provided by the coupled guide part and thus it is easy to move to a location to be punched, and it is easy to find a location to be punched and perform fastening by using the coupled jig unit.

BEST MODE

Figure 1:
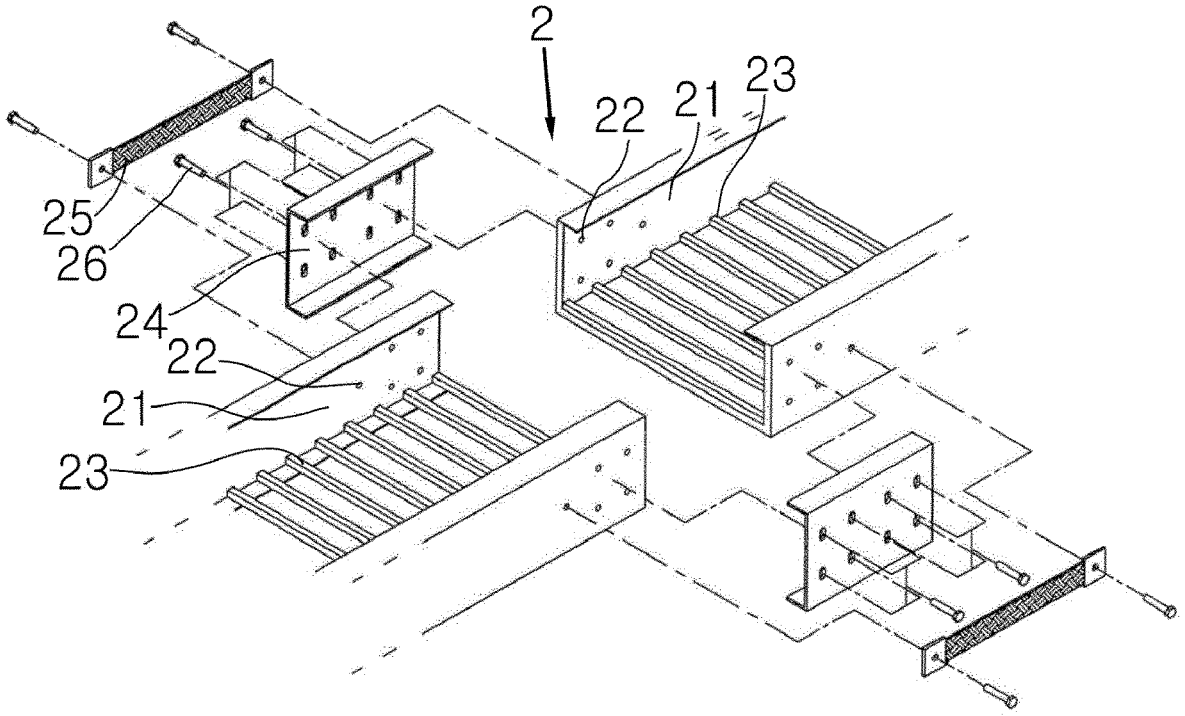
FIG. 1 is an assembly perspective view of a conventional cable tray.

The present invention relates generally to a rechargeable hydraulic punching machine for a cable tray, and more particularly to a rechargeable hydraulic punching machine for a cable tray, in which a battery, a grip, a motor, a hydraulic cylinder, a punch, and a die are sequentially disposed along a straight line, a C-shaped head coupled to the head of the hydraulic cylinder is disposed, the punch and the die are disposed at both open ends of the C-shaped head, respectively, punch guards are disposed on a portion of the head spaced apart from both sides of the punch, the battery is configured to be charged and detachably attached, the motor transfers power to the hydraulic cylinder by using the power of the battery, and the hydraulic cylinder punches assembly holes of a cable tray by pushing the punch in the direction of the die by using hydraulic power based on the power of the motor, thereby enabling the battery to be recharged and replaced and also facilitating the carrying and use of the rechargeable hydraulic punching machine.

The present invention includes a grip part, an operation part, a head part, and also includes a marking pen part, a guide part, and a jig part coupled thereto. These will be sequentially described as follows.

First, the grip part 110 includes a battery 111, a grip 112, and a switch 113. The battery 111 is constructed in a structure that may be rechargeable and is detachably attached to the grip 112. The grip 112 is constructed in a rod structure extending from one side of the battery 111. The switch 113 protrudes from the grip 112, and, when operated, connects or cuts off the power of the battery 111 and adjusts the amount of power to be supplied.

Next, the operation part 120 includes a motor 121, a hydraulic cylinder 122, and a punch 123. The motor 121 is disposed on one side of the grip 112, and supplies power to the hydraulic cylinder 122 by using the power of the battery 111. The hydraulic cylinder 122 is disposed on one side of the motor 121, and hydraulically moves the punch 123 to one side or the other side by using the power of the motor 121.

Figure 2:
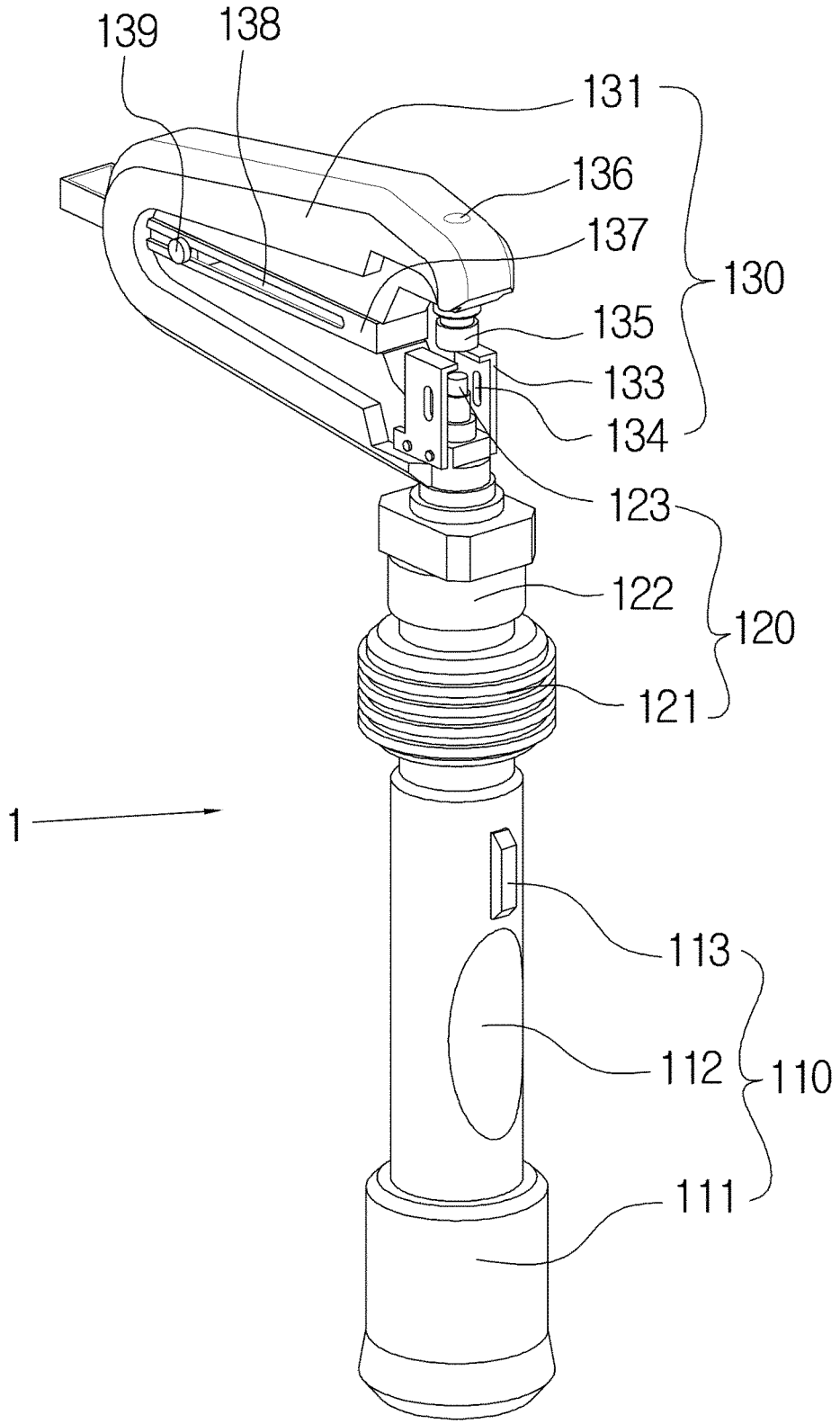
FIG. 2 is a perspective view of a rechargeable hydraulic punching machine for a cable tray according to an example of the present invention.
Figure 3:
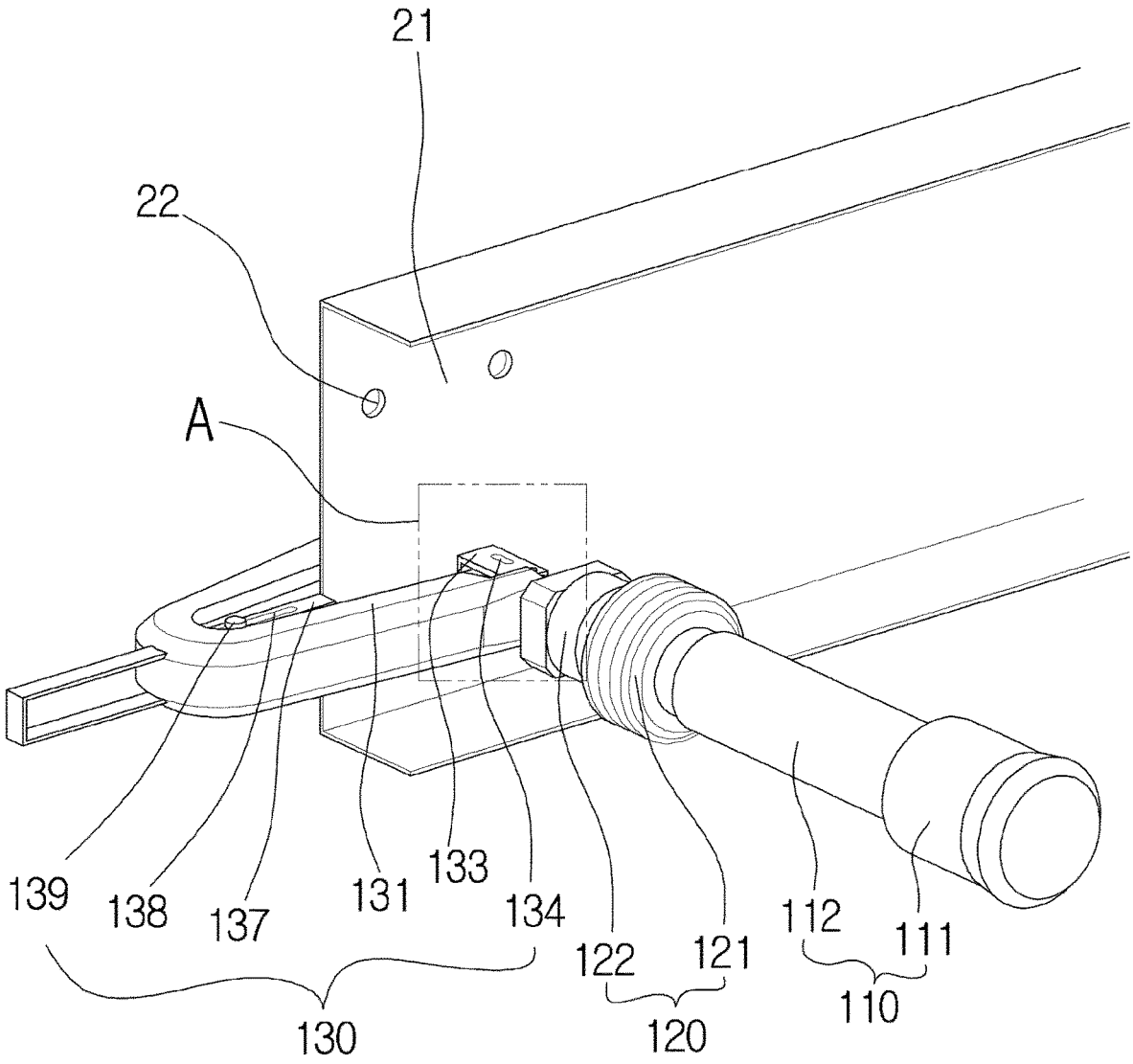
FIG. 3 is a perspective view showing the use of the rechargeable hydraulic punching machine of FIG. 2.

Furthermore, the punch 123 is constructed in the form of a circular, elliptical, rectangular or polygonal column of 5 to 15 mm diameter, which is the diameter of the assembly hole 22 of the cable tray 2, and is disposed on one side of the hydraulic cylinder 122. As shown in FIG. 2, the battery 111, the grip 112, the motor 121, the hydraulic cylinder 122, and the punch 123 described above are sequentially disposed on the same straight line.

Next, the head part 130 includes a head 131, punch guards 133, a die 135, and a movement limiting element 137. The head 131 is formed in a C- or sideways "U"-shaped structure, as shown in FIG. 2. The head part 130 has a length in an open direction. The die 135 is disposed on one of both open ends of the head part 130, the punch 123 is disposed on the other one of both the open ends, and the hydraulic cylinder 122 is connected to the other one on which the punch 123 is disposed.

Figure 9:
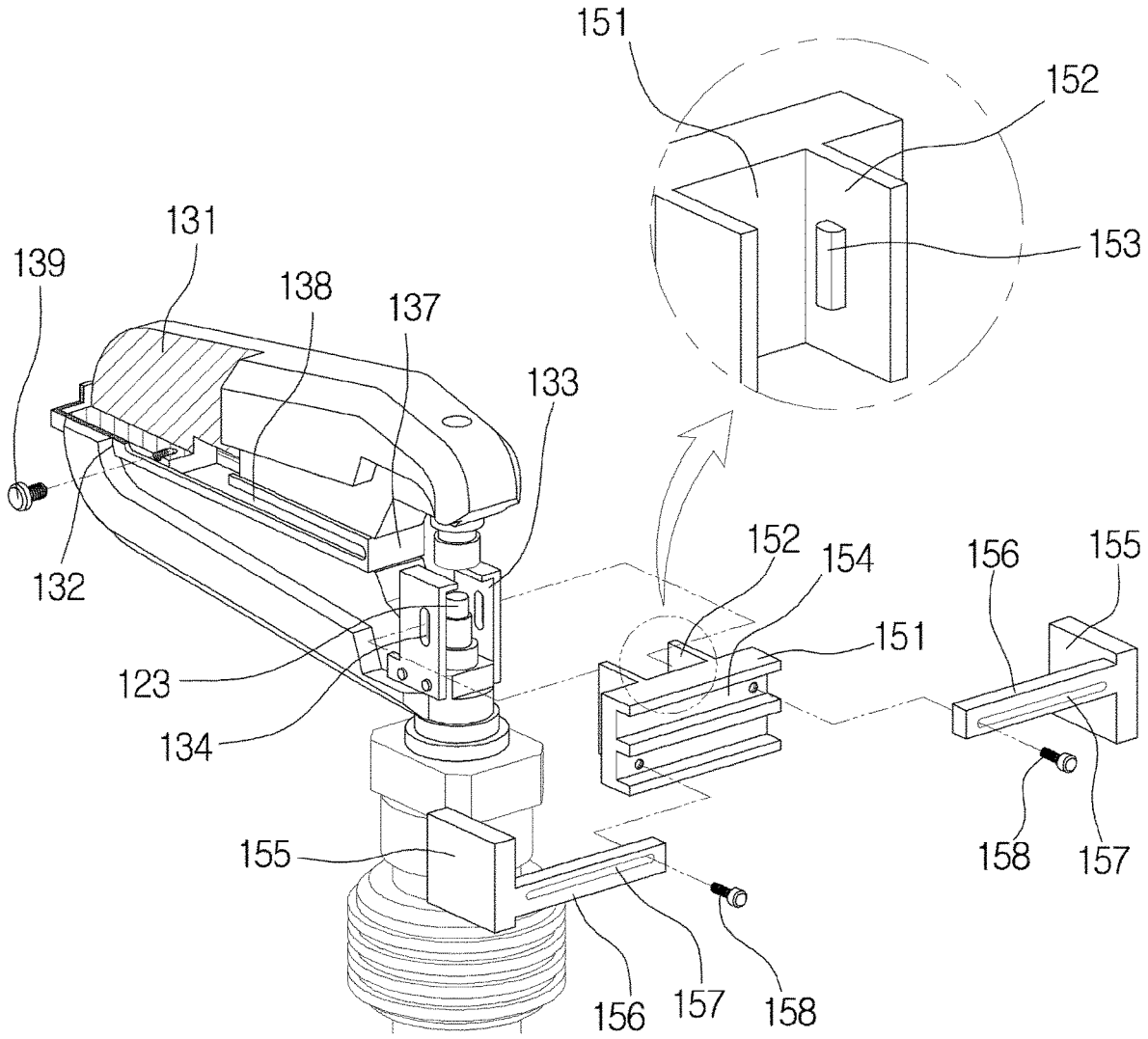
FIG. 9 is an exploded perspective view of FIG. 8.

In this case, an empty space is formed in the side of the head 131 opposite to the open side, as in FIG. 9. The straight distance from the end of this empty space to the punch 123 is 80 to 130 mm, which is half the length of the joint connector 24 and bonding jumper 25 of the cable tray 2. A moving hole 132 corresponding to the section of the movement limiting hole 137 penetrates from both sides of an end of the empty space to the opposite side of the open direction.

Figure 5:
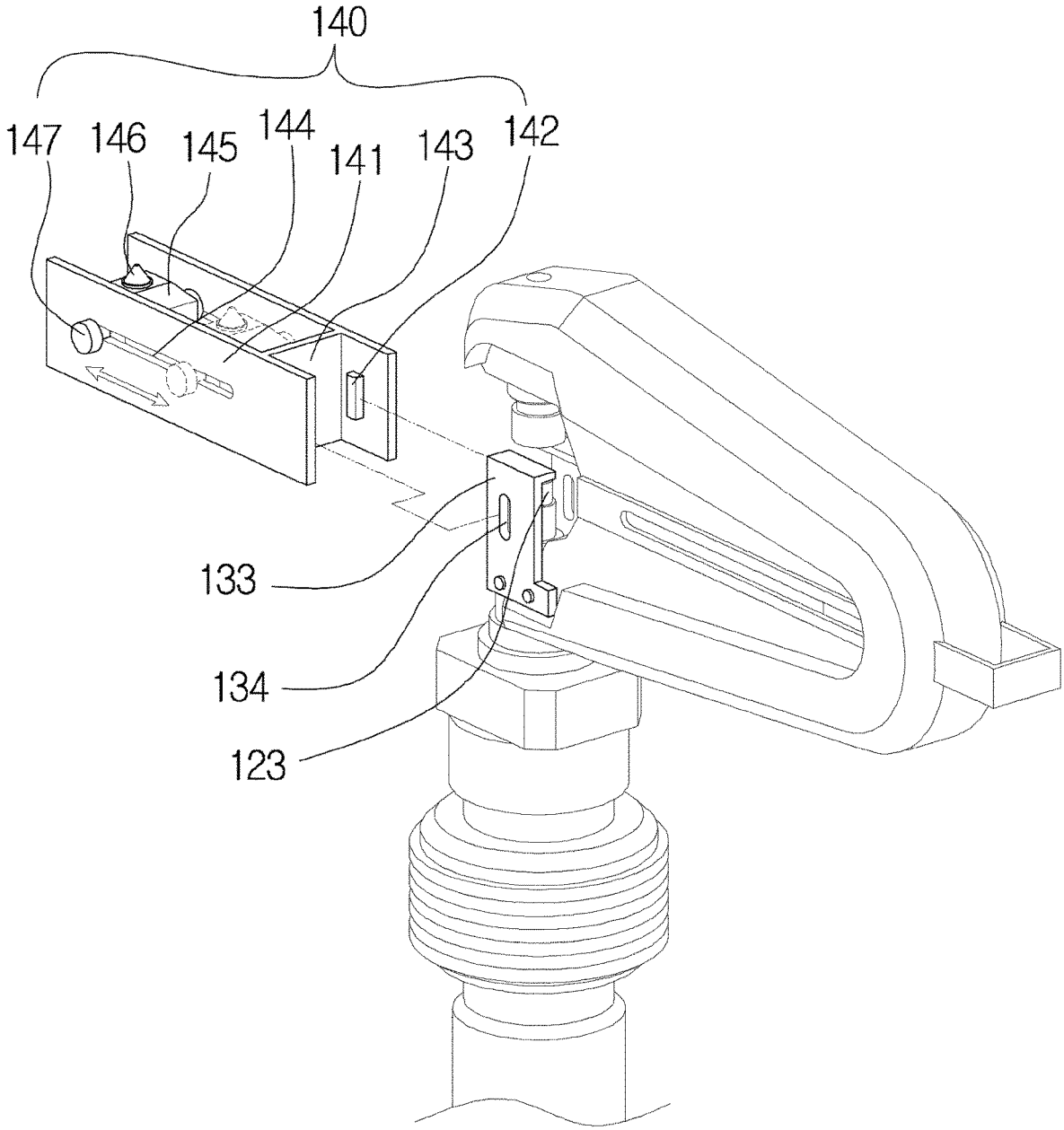
FIG. 5 is a perspective view showing a state in which the marking pen part is coupled to the rechargeable hydraulic punching machine according to an example of the present invention.
Figure 8:
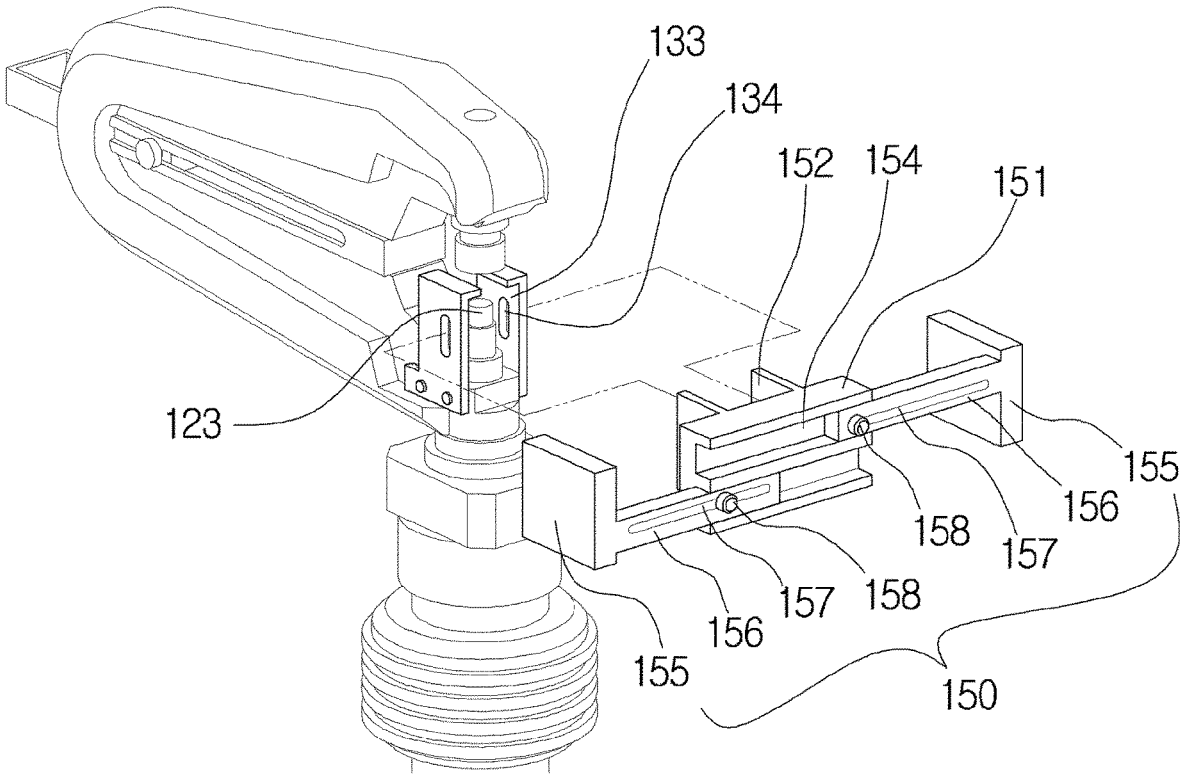
FIG. 8 is a perspective view showing a state in which a guide part is coupled to the rechargeable hydraulic punching machine according to an example of the present invention.
Figure 11:
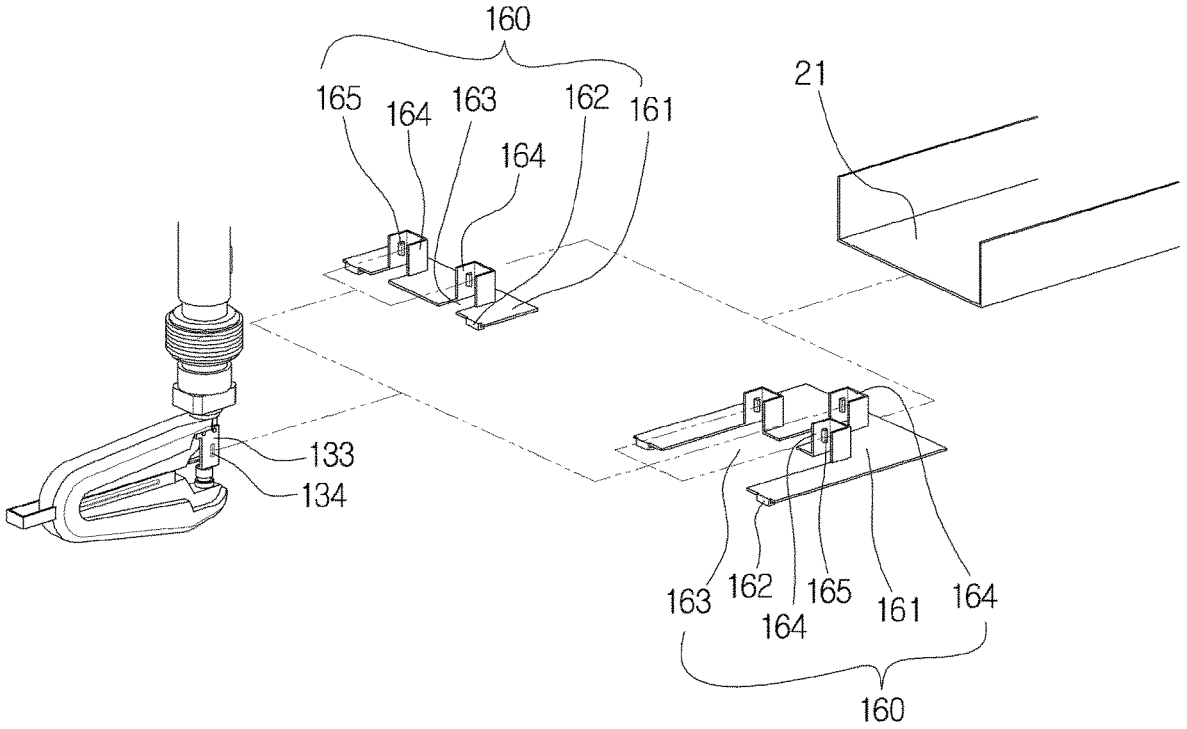
FIG. 11 is a perspective view showing a state in which a punching location fastening part is coupled to the rechargeable hydraulic punching machine according to an example of the present invention.
Figure 12:
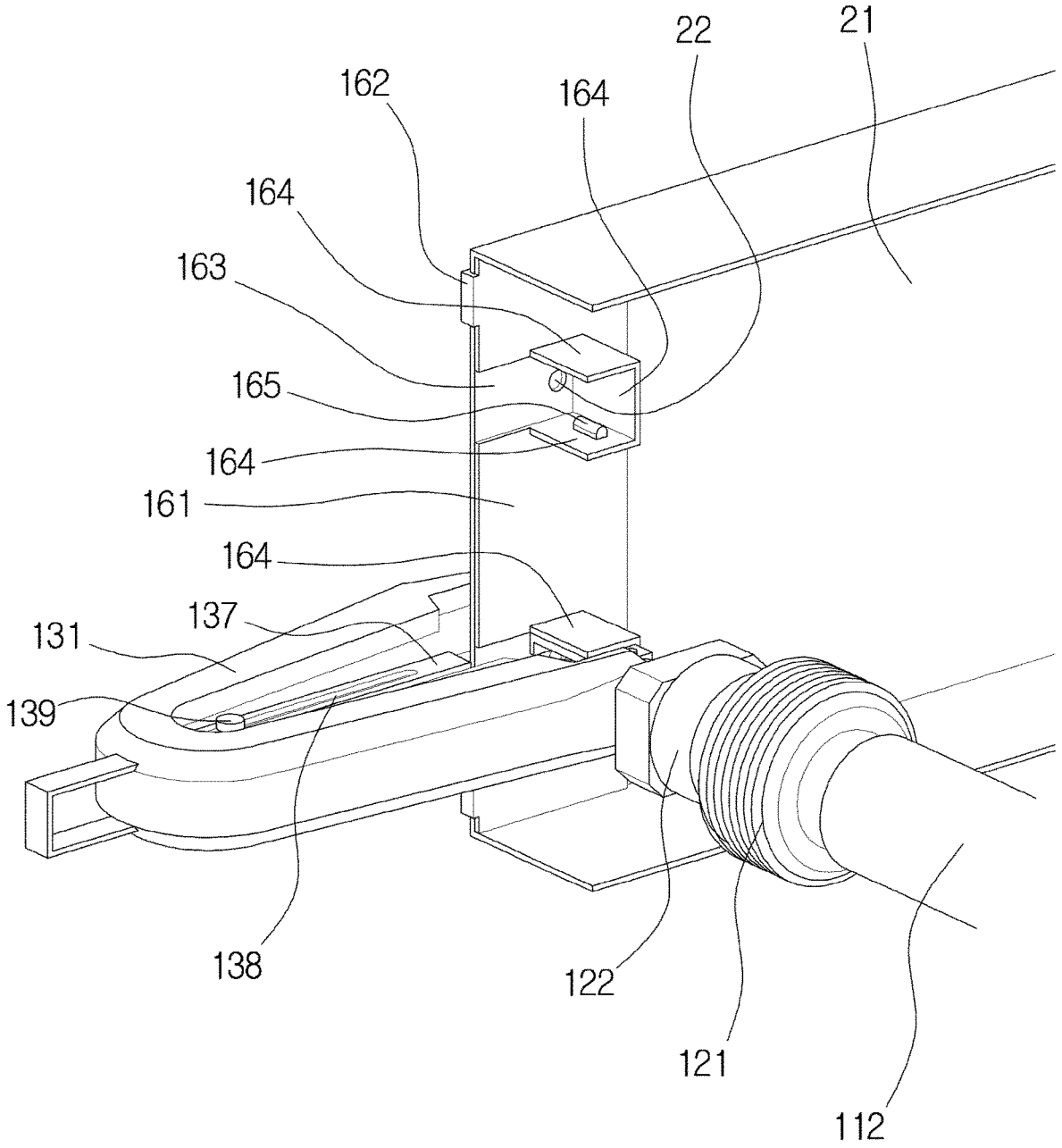
FIG. 12 is a perspective view showing the use of the rechargeable hydraulic punching machine of FIG. 11.

Furthermore, the punch guards 133 includes plates spaced apart from both sides of the punch 123 disposed on the head 131, as shown in FIG. 2. The punch guards 133 are wider than the diameter of the punch 123 and higher than the punch 123 pulled toward the hydraulic cylinder 122. Spacing is performed such that the straight distance between the punch guards 133 and the die 135 is 20 to 30 mm, so that there is formed a space into which the side plate of the side rail 21 of the cable tray 2 is inserted sufficiently. As shown in FIGS. 5, 8, and 11, there are formed coupling holes 134 into which the marking pen part 140, the guide part 150 and the jig part 160 to be described later are coupled.

Figure 4:
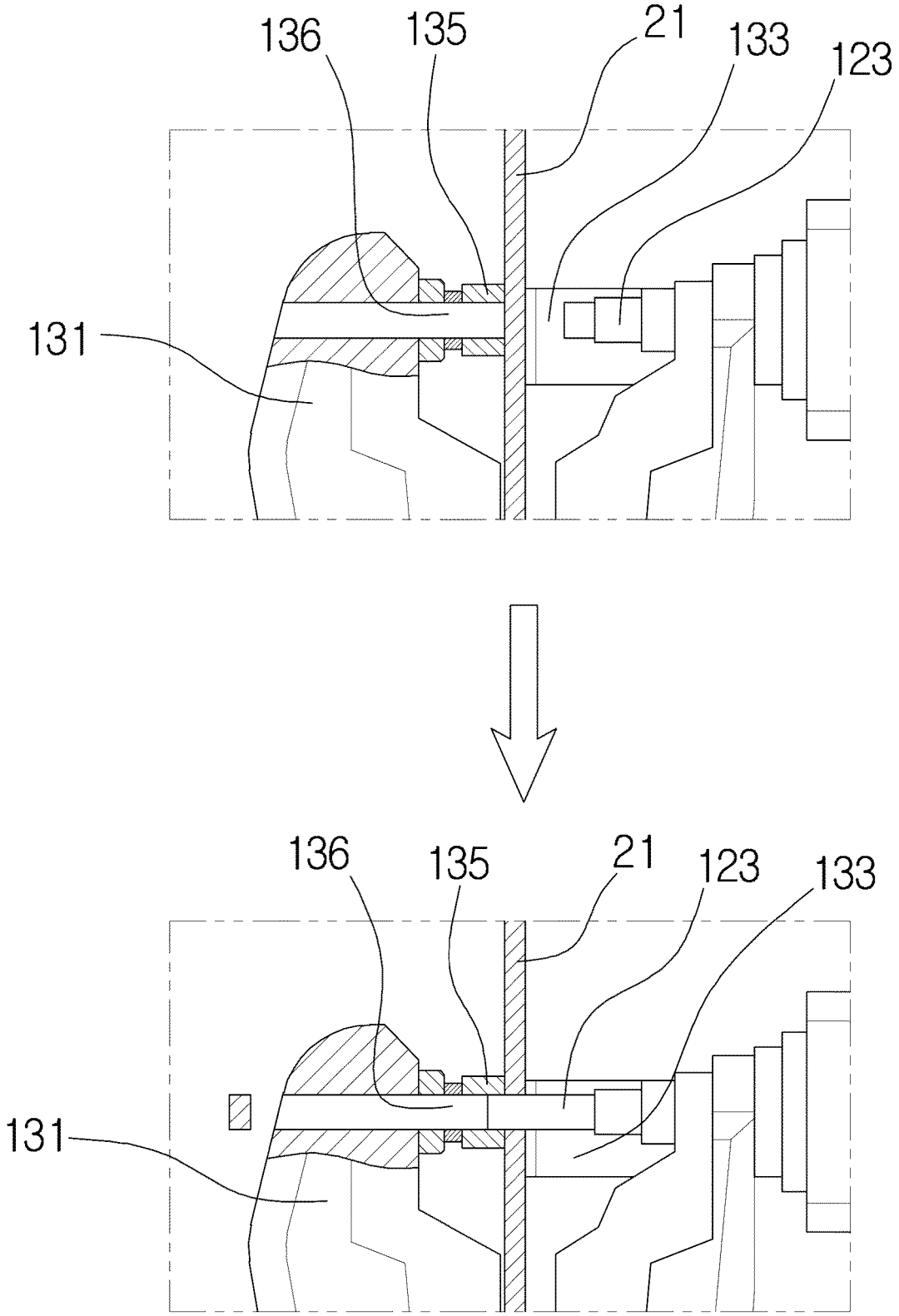
FIG. 4 is a side view of part A of FIG. 3.

Furthermore, the die 135 is disposed on one of both the open ends of the head 131, and is spaced apart from the punch 123 in the same straight line along which the punch 123 is moved. As shown in FIG. 4, a punch hole 136 configured to correspond to the punch 123 and receive the punch 123 is formed through the die 135.

In this case, the die 135 and the punch 123 may be replaced with a die 135 and punch 123 having different diameters or shapes and be coupled to and used on the head 131 according to the selection of a user.

Furthermore, as shown in FIG. 9, the movement limiting element 137 is configured such that a plate passing through two movement holes 132 is bent in a rectangular form and surrounds the head 131 while blocking the empty space of the head 131, an elongated hole 138 having a length of 80 to 130 mm is formed on both sides, and a fastening screw 139 configured to be screwed into the head 131 through the elongated hole 138 is provided.

Figure 6:
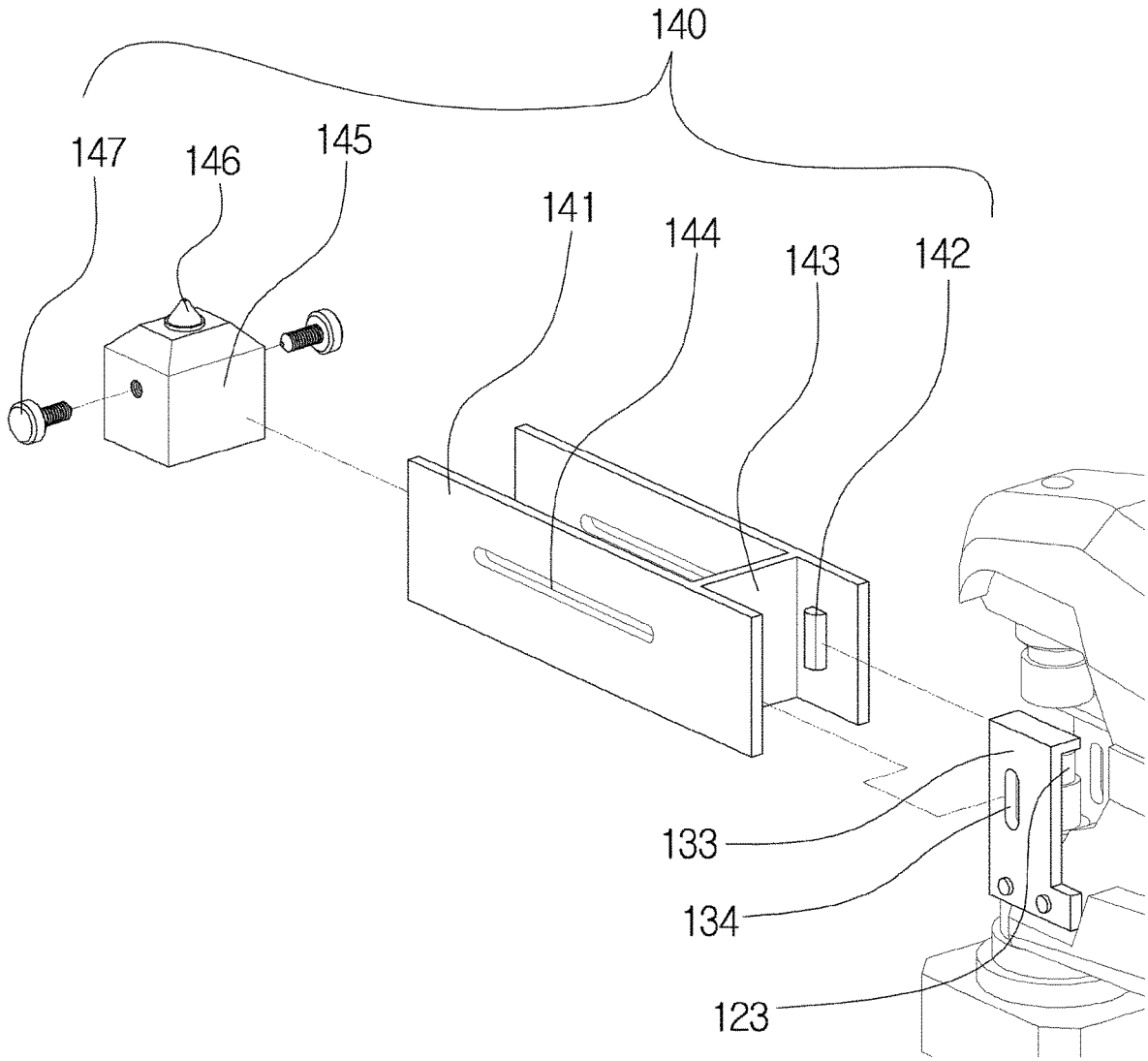
FIG. 6 is an exploded perspective view of FIG. 5.
Figure 7:
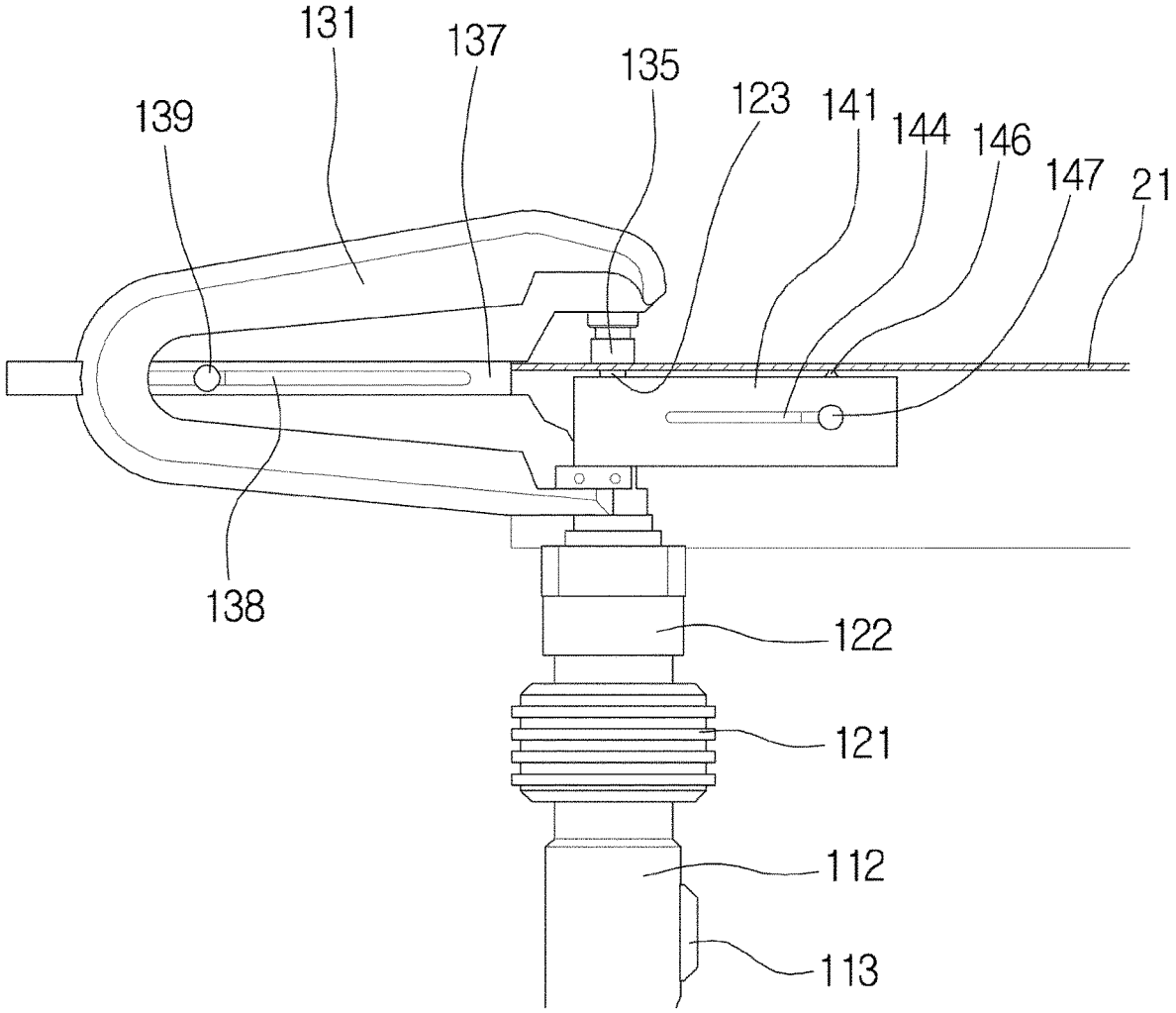
FIG. 7 is a side view showing the use of the rechargeable hydraulic punching machine of FIG. 5.

Next, as shown in FIG. 5, the marking pen part 140 includes pen support plates 141 and a marking pen block 145. As shown in FIG. 6, the pen support plates 141 is configured such that two plates having a length in the open direction of the head 131 are disposed in parallel, the punch guards 133 are inserted into one side of the pen support plates 141 in their longitudinal direction, coupling protrusions 142 are formed inward from the first sides of the pen support plates 141 and fitted into the coupling holes 134 of the punch guards 133, a connection plate 143 configured to connect the two pen support plates 141 is formed on the other side of the coupling protrusion 142, i.e., an end to which the punch guards 133 are coupled, and elongated holes 144 having a length of 40 to 50 mm are formed in the pen support plates 141 on the other side of the connection plate 143 in the longitudinal direction.

Furthermore, as shown in FIG. 5, the marking pen block 145 is configured such that it is disposed between the two pen support plates 141 through which the elongated holes 144 are formed, it is movable along the elongated holes 144, a marking pen 146 protrudes in a direction perpendicular to the longitudinal direction of the elongated holes 144, and the marking pen block 145 includes fastening screws 147 screwed into the marking pen block 145 through the elongated holes 144 of the pen support plates 141.

Next, as shown in FIG. 8, the guide part 150 includes a guide member 151 and guides 155. As shown in FIG. 9, the guide member 151 blocks the two punch guards 133 over a length of 30 to 40 mm I a direction perpendicular to the open direction of the head 131, two coupling plates 152 protrude in parallel in the thickness direction of the guide member 151, the two punch guards 133 are inserted between the two protruding coupling plates 152, coupling protrusions 153 configured to be fitted into the coupling holes 134 of the punch guards 133 protrude inward from the coupling plates 152, and two guide grooves 154 are formed in parallel in the longitudinal direction on the other side of the thickness direction.

Figure 10:
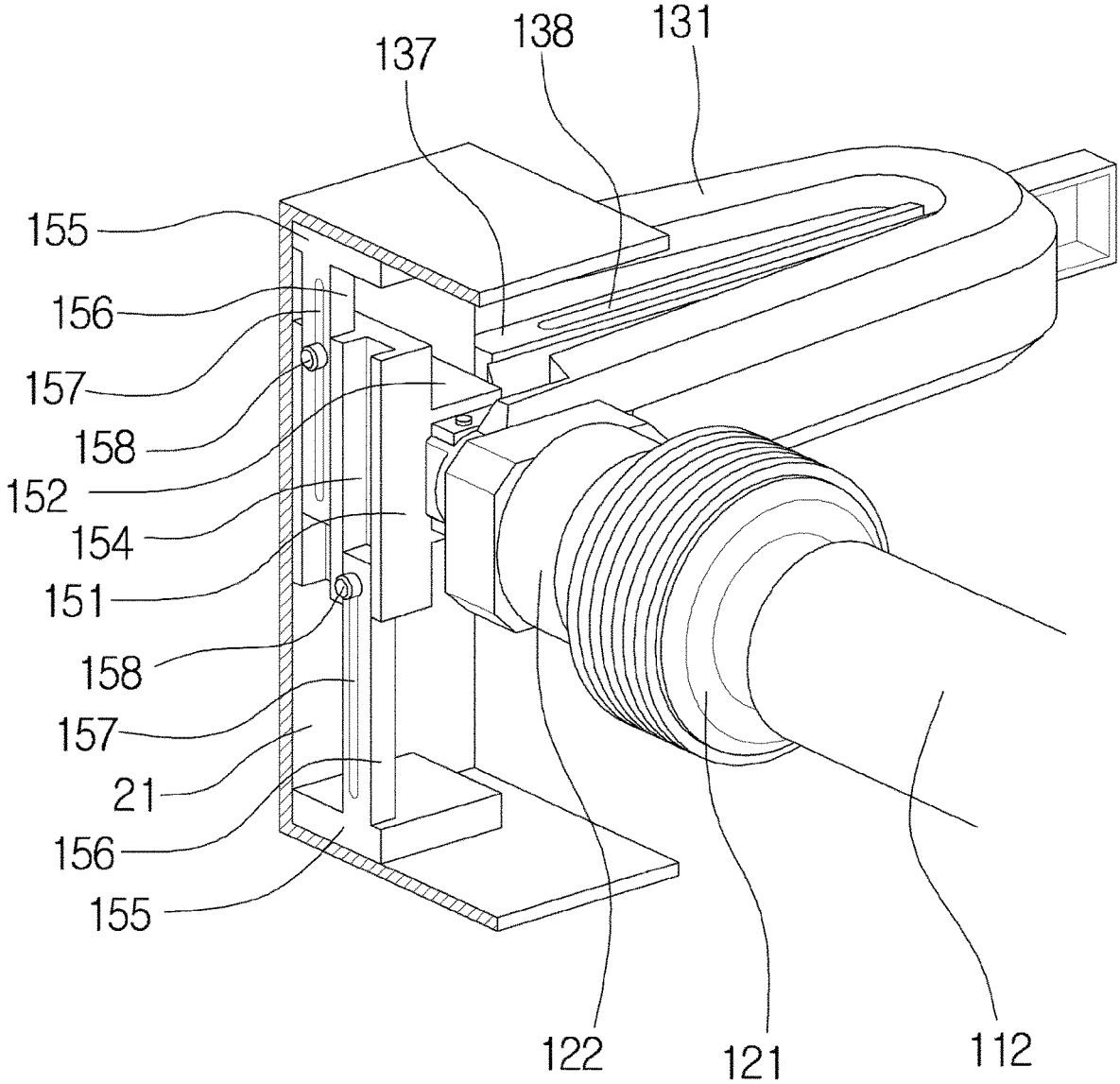
FIG. 10 is a perspective view showing the use of the rechargeable hydraulic punching machine of FIG. 8.

Furthermore, the guides 155 are disposed on both sides of the guide member 151 in the longitudinal direction thereof. Each of the guides 155 is configured such that a support bar 156 is formed along each of the guide grooves 154 over a length of 30 to 40 mm and is movable along the guide groove 154, as shown in FIGS. 8 and 10, an elongated hole 157 is formed in the support bar 156 in the longitudinal direction thereof, and the guide 155 includes a fastening screw 158 coupled to the guide member 151 through the elongated hole 157 of the support bar 156.

In this case, the fastening screw 158 is screwed to the guide member 151 inside the guide groove 154 through the elongated hole 157, and is screwed at an end of a direction in which the corresponding guide 155 is located.

Next, as shown in FIG. 11, the jig part 160 includes a jig plate 161 configured to come into close contact with the side rail 21 of the cable tray 2. The jig part 160 is further configured such that catch hooks 162 protruding from ends of one side of the jig plate 161, bent and configured to be fitted into or caught on an end of the side rail 21, an introduction path 163 extending from an end of one side of the jig plate 161 to each punching location is formed at each punching location of the jig plate 161 in close contact with the side rail 21, coupling plates 164 protrude along the edges of the introduction path 163 at each punching location so that the two punch guards 133 are inserted between the coupling plates 164, and coupling protrusions 165 configured to be fitted into the coupling holes 134 of the punch guards 133 protrudes inward from the respective coupling plates 164.

In this case, since four or five assembly holes 22 need to be punched into the side rail 21, the jig plates 161 are of a short jig plate type and of a long jig plate type. In the case of the short jig plate type, the jig plate 161 is formed short, the introduction path 163 and the coupling plates 164 are formed in the short jig plate 161 to correspond to the two assembly holes 22 of one side of the side rail 21 to be punched. In the case of the long jig plate type, the jig plate 161 is formed long, and the introduction path 163 and the coupling plates 164 are formed in the long jig plate 161 to correspond to two or three assembly holes 22 subsequent to the assembly holes 22 corresponding to the type of short jig plate 161 in the side rail 22.

The rechargeable hydraulic punching machine 1 for a cable tray, which is configured as described above, punches the assembly holes 22 of the cable tray 2. First, the assembly holes 22 of the cable tray 2 are punched to couple the two side rails 21 of the cable tray 2 in the cable tray 2 in contact with each other, and the joint connectors 24 and bonding jumpers 25 covering the side rails 21 for the purpose of length extension, a change in the length of the standardized cable tray 2, and the curved connection of the cable tray 2, as shown in FIG. 1.

In general, the assembly holes 22 are formed in the side rails 21, the joint connectors 24 and the bonding jumpers 25 in advance in order to fit the place where the cable tray 2 is to be installed, and length extension or curved connection. However, due to an error from a site, a change in plan, or a change in the length of the standardized cable tray (2), the side rails 21 are cut into a predetermined length and the assembly holes 22 are punched using the carried rechargeable hydraulic punching machine 1 for a cable tray according to the present invention at the installation site. Each of the side rails 21 in which the assembly holes 22 is to be punched is inserted between the punch 123 and the die 135 and is then punched by operating the switch 113.

In this case, the assembly holes 22 for coupling with the joint connectors 24 having an average length of 160 mm or the bonding jumpers 25 having an average length of 255 mm have a distance of 80 or 125 mm from an end of the side rail 21. According to the location of the assembly hole 22 of the side rail 21 to be currently punched, the movement limiting element 137 blocking the empty space of the head 131 at a distance of 80 to 130 mm is moved and fixed with the fixing screw 139. This prevents the side rail 21 from entering deeper into the empty space of the head 131 and also prevents a punching position from shifting.

Furthermore, when the cable tray 2 is installed, the rechargeable hydraulic punching machine 1 for a cable tray is carried and the assembly holes 22 of the cable tray 2 are punched without the connection of a separate electrical line. When the remaining charge of the battery 111 is insufficient, the battery 111 is replaced with another battery, and the exhausted battery 111 is recharged and then used.

In addition, when the assembly holes 22 of the cable tray 2 are punched, the marking pen part 140, the guide part 150 and the jig part 160 are used in combination. First, the marking pen part 140 is operated such that the two punch guards 133 are inserted into one side of the two pen support plates 141 from which the coupling protrusions 142 protrude so that the coupling protrusions 142 are fitted into the coupling holes 134 of the punch guards 133, the marking pen block 145 is moved along the long holes having a length of 40 to 50 mm formed in the pen support plates 141 by the distance from the current assembly hole 22 to be punched to the next assembly hole 22 to be punched, and then clamped and fastened by the fastening screws 147, and the next position to be punched is marked with a marking pen 146 while the assembly hole 22 is being punched.

Next, the guide part 150 is operated such that the two punch guards 133 are inserted into the two coupling plates 152 from which the coupling protrusions 153 protrude so that the coupling protrusions 153 are fitted into the coupling holes 134 of the punch guards 133, the support bar 156 of the guide 155 is moved along the guide groove 154 having a length of 30 to 40 mm formed in the guide member 151 by the distance from both ends of the side rail 21 to the assembly holes 22 to be punched and is fastened by tightening the fastening screws 158, and the guides 155 put into the sideways U sections of the side rail 21 are moved to the locations at which the assembly holes 22 to be punched and are punched.

In this case, the pairs of assembly holes 22 are symmetrically formed in the side rails 21 based on the center line in the longitudinal direction. The guide part 150 fastened to fit the assembly holes 22 on either side is separated from the punch guard 133, is rotated by 180° and is coupled to the punch guard 133 again. Accordingly, it may be possible to guide the other assembly holes 22 which is symmetrical with respect to the center line in this direction.

Next, the jig part 160 is operated such that the short jig plate type is first brought into close contact with the side rail 21 in which the assembly holes 22 will be punched, the side rail 21 is pushed such that an end thereof is fitted into or caught on the gap of the catch hook 162 of the jig plate 161, the punch guards 133 are moved along the introduction path 163 of the jig plate 161 and fitted into the coupling plates 164 at the end of the introduction path 163, the coupling protrusions 165 of the coupling plates 164 are fitted into the coupling holes 134 of the punch guards 133, an assembly hole 22 at a corresponding location is punched, the punch guards 133 are moved along another introduction path 163 to punch another assembly hole 22, the punch guards 133 are inserted between the coupling plates 164, and then punching is performed 에 편칭한다 .

Furthermore, the short jig plate type of jig part 160 is separated from the side rail 21, the long jig plate type of jig part 160 is coupled to the side rail 21, movement is performed along the introduction path 163 for each of the assembly holes 22 to be punched with the previous short jig plate type, the punch guards 133 are inserted into the coupling plates 164, and then punching is performed.

As described above, the present invention is characterized in that it is possible to charge and replace the battery 111, it is easy to carry and use the rechargeable hydraulic punching machine, and hydraulic punching is performed, thereby reducing surrounding contamination attributable to the formation of the assembly holes 22 compared to drilling.

In addition, it is easy to determine a location to be punched next by using the coupled marking pen unit 140, guiding is provided by the coupled guide part 150 and thus it is easy to move to a location to be punched, and it is easy to find a location to be punched and perform fastening by using the coupled jig unit 160.

The invention claimed is:

1. A rechargeable hydraulic punching machine for a cable tray, the rechargeable hydraulic punching machine comprising:

a grip part including a battery configured to be recharged, a grip disposed on one side of the battery and configured such that the battery is detachably attached thereto, and a switch configured to protrude from the grip and adjust supply of power of the battery;

an operation part including a motor disposed on one side of the grip and configured to supply power by using the power of the battery, a hydraulic cylinder disposed on one side of the motor and configured to apply hydraulic power by using power of the motor, and a punch disposed on one side of the hydraulic cylinder and configured to be moved along a longitudinal direction of the hydraulic cylinder by hydraulic power of the hydraulic cylinder; and a head part including a head formed in a C shape and configured such that the punch is disposed on one of open ends of the head, two punch guards disposed on a portion of the head spaced apart from both sides of the punch, a die disposed on a remaining one of both the open ends of the head, and a punch hole configured to penetrate the die and receive the punch;

wherein a cable tray in which assembly holes is to be punched is inserted between the punch and the die and then punching is performed, thereby enabling the battery to be charged and replaced and also facilitating carrying and use of the rechargeable hydraulic punching machine, wherein:

coupling holes are formed in the punch guards of the head part, respectively;

the rechargeable hydraulic punching machine further comprises a marking pen part comprising: two pen support plates configured such that the pen support plates are disposed in parallel and the two punch guards are inserted into one side of the pen support plates, respectively; coupling protrusions configured to protrude inward from first sides of the pen support plates and be fitted into the coupling holes; a connection plate configured to connect the two pen support plates; elongated holes formed in the pen support plates on a remaining side of the connection plate in a longitudinal direction; a marking pen block disposed between the two pen support plates in which the elongated holes are formed; a marking pen configured to protrude vertically from the marking pen block; and fastening screws screwed to the marking pen block through the elongated holes, respectively; and the punch guards are inserted into one side of the marking pen part, the marking pen block on the other side is moved to a location to be punched next along the elongated holes, and the marking pen block is fastened by the fastening screws, thereby allowing the location to be punched next to be marked when the assembly holes of the cable tray are punched.

2. A rechargeable hydraulic punching machine for a cable tray, the rechargeable hydraulic punching machine comprising:

a grip part including a battery configured to be recharged, a grip disposed on one side of the battery and configured such that the battery is detachably attached thereto, and a switch configured to protrude from the grip and adjust supply of power of the battery;

an operation part including a motor disposed on one side of the grip and configured to supply power by using the power of the battery, a hydraulic cylinder disposed on one side of the motor and configured to apply hydraulic power by using power of the motor, and a punch disposed on one side of the hydraulic cylinder and configured to be moved along a longitudinal direction of the hydraulic cylinder by hydraulic power of the hydraulic cylinder; and a head part including a head formed in a C shape and configured such that a punch is disposed on one of open ends of the head, two punch guards disposed on a portion of the head spaced apart from both sides of the punch, a die disposed on a remaining one of both the open ends of the head, and a punch hole configured to penetrate the die and receive the punch;

wherein a cable tray in which assembly holes is to be punched is inserted between the punch and the die and then punching is performed, thereby enabling the battery to be charged and replaced and also facilitating carrying and use of the rechargeable hydraulic punching machine, wherein:

coupling holes are formed in the punch guards of the head part, respectively;

the rechargeable hydraulic punching machine further comprises: a guide part including: a long guide member configured to have a length in a direction perpendicular to a longitudinal direction of the head; two coupling plates configured to protrude from the guide member in parallel in a thickness direction and configured such that the two punch guards are inserted into the protruding portions; coupling protrusions configured to protrude inward from the coupling plates and to be fitted into the coupling holes; two guide grooves formed in parallel in a longitudinal direction on a remaining side of the thickness direction; guides disposed on both sides of the guide member in the longitudinal direction; support bars formed along the guide grooves and configured to be movable along the guide groove in the respective guides; elongated holes formed in the respective support bars in a longitudinal direction thereof; and fastening screws coupled to the guide member through the elongated holes of the support bars; and the two punch guards are inserted between the two coupling plates, in the side rail of the cable tray, and a distance between the two guides is adjusted to fit a distance from a punching location to both ends of a sideways U-shaped section of the side rail to guide a width of the side rail, thereby facilitating adjustment of a location to be punched in the side rail of the cable tray.

3. A rechargeable hydraulic punching machine for a cable tray, the rechargeable hydraulic punching machine comprising:

a grip part including a battery configured to be recharged, a grip disposed on one side of the battery and configured such that the battery is detachably attached thereto, and a switch configured to protrude from the grip and adjust supply of power of the battery;

an operation part including a motor disposed on one side of the grip and configured to supply power by using the power of the battery, a hydraulic cylinder disposed on one side of the motor and configured to apply hydraulic power by using power of the motor, and a punch disposed on one side of the hydraulic cylinder and configured to be moved along a longitudinal direction of the hydraulic cylinder by hydraulic power of the hydraulic cylinder; and a head part including a head formed in a C shape and configured such that a punch is disposed on one of open ends of the head, two punch guards disposed on a portion of the head spaced apart from both sides of the punch, a die disposed on a remaining one of both the open ends of the head, and a punch hole configured to penetrate the die and receive the punch;

wherein a cable tray in which assembly holes is to be punched is inserted between the punch and the die and then punching is performed, thereby enabling the battery to be charged and replaced and also facilitating carrying and use of the rechargeable hydraulic punching machine, wherein:

coupling holes are formed in the punch guards of the head part, respectively;

the rechargeable hydraulic punching machine further comprises a jig part including: a jig plate configured to come into close contact with the side rail of the cable tray; catch hooks configured to protrude from ends of one side of the jig plate, bent and configured to be fitted into or caught on an end of the side rail, an introduction path configured to extend from an end of one side of the jig plate to each punching location; coupling plates configured to protrude along edges of the introduction path at each punching location so that the two punch guards are inserted between the coupling plates; and coupling protrusions configured to protrude inward from the coupling plates and be fitted into the coupling holes; and the jig plate is brought into close contact with the side rail, end of the side rail is caught on the catch hooks, the two punch guards are moved along the introduction path for each punching location, and punching is performed while being inserted between the catch plates, thereby facilitating punching of assembly holes of the cable tray.

4. The rechargeable hydraulic punching machine of claim 1, wherein:

the head of the head part is formed such that a straight-line distance from an end of an empty space formed on a side opposite to the open ends to the punch is 80 to 130 mm and a straight-line distance from the punch and the punch guards to the die is 20 to 30 mm, and a movement hole configured to penetrate the side opposite to the open ends is formed at the end of the empty space;

the head part includes a movement limiting element configured to pass through the movement hole and block the empty space of the head;

the movement limiting element includes an elongated hole having a length of 80 to 130 mm and a fastening screw screwed into the head through the elongated hole; and a location of the movement limiting element is adjusted by a length from an end of the cable tray to a punching location, the cable tray is inserted into the head, and then punching is performed, thereby facilitating adjustment of a location of the cable tray to be punched.

5. The rechargeable hydraulic punching machine of claim 2, wherein:

the head of the head part is formed such that a straight-line distance from an end of an empty space formed on a side opposite to the open ends to the punch is 80 to 130 mm and a straight-line distance from the punch and the punch guards to the die is 20 to 30 mm, and a movement hole configured to penetrate the side opposite to the open ends is formed at the end of the empty space;

the head part includes a movement limiting element configured to pass through the movement hole and block the empty space of the head;

the movement limiting element includes an elongated hole having a length of 80 to 130 mm and a fastening screw screwed into the head through the elongated hole; and a location of the movement limiting element is adjusted by a length from an end of the cable tray to a punching location, the cable tray is inserted into the head, and then punching is performed, thereby facilitating adjustment of a location of the cable tray to be punched.

6. The rechargeable hydraulic punching machine of claim 3, wherein:

the head of the head part is formed such that a straight-line distance from an end of an empty space formed on a side opposite to the open ends to the punch is 80 to 130 mm and a straight-line distance from the punch and the punch guards to the die is 20 to 30 mm, and a movement hole configured to penetrate the side opposite to the open ends is formed at the end of the empty space;

the head part includes a movement limiting element configured to pass through the movement hole and block the empty space of the head;

the movement limiting element includes an elongated hole having a length of 80 to 130 mm and a fastening screw screwed into the head through the elongated hole; and a location of the movement limiting element is adjusted by a length from an end of the cable tray to a punching location, the cable tray is inserted into the head, and then punching is performed, thereby facilitating adjustment of a location of the cable tray to be punched.

* * * * *